US005941643A

United States Patent [19]

Linkiewicz

[11] Patent Number: 5,941,643

[45] Date of Patent: Aug. 24, 1999

[54] PARTIALLY ZIPPERED POUCH AND MACHINE FOR MAKING SAME

[75] Inventor: John M. Linkiewicz, Prospect Heights, Ill.

[73] Assignee: Triangle Package Machinery Company, Chicago, Ill.

[21] Appl. No.: 09/056,545

[22] Filed: Apr. 7, 1998

[51] Int. Cl.[6] ..... B65D 33/16

[52] U.S. Cl. ..... 383/210; 383/61; 383/63; 383/94; 383/906

[58] Field of Search ..... 383/61, 63, 210, 383/211, 906, 65, 93, 94, 95

[56] References Cited

U.S. PATENT DOCUMENTS

| | | | |
|---|---|---|---|
| 4,332,344 | 6/1982 | Strodthoff | 383/63 |
| 4,787,755 | 11/1988 | Branson | 383/65 |
| 4,953,708 | 9/1990 | Beer et al. | 383/61 |
| 5,113,555 | 5/1992 | Wilson et al. | 383/63 |
| 5,240,112 | 8/1993 | Newbunger | 383/63 |
| 5,810,478 | 9/1998 | LaFleur | 383/63 |

*Primary Examiner*—Stephen P. Garbe
*Attorney, Agent, or Firm*—Brinks Hofer Gilson & Lione

[57] ABSTRACT

A standard vertical form, fill and seal machine is provided with a change part that allows the marginal edges of the film to be formed into a lap or fold over seam at a location offset from the center of the flat front surface of a D-shape forming tube. The film is formed into a loop at the central portion of the rear generally cylindrical section of the forming tube and an interlocked zipper strip is fed into this loop and bonded to the inner surface of the loop. The cross seam for the bag is formed in the fore and aft direction so that it will be in the plane of the interlocked zipper strip.

3 Claims, 3 Drawing Sheets

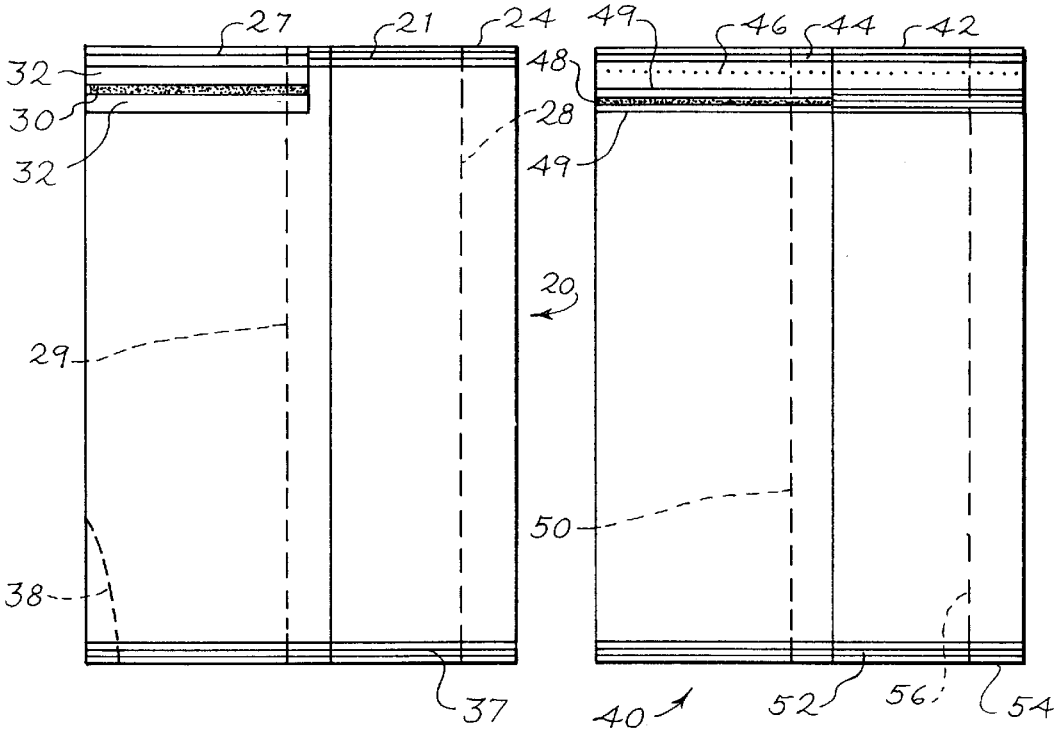
Fig. 1
Fig. 3
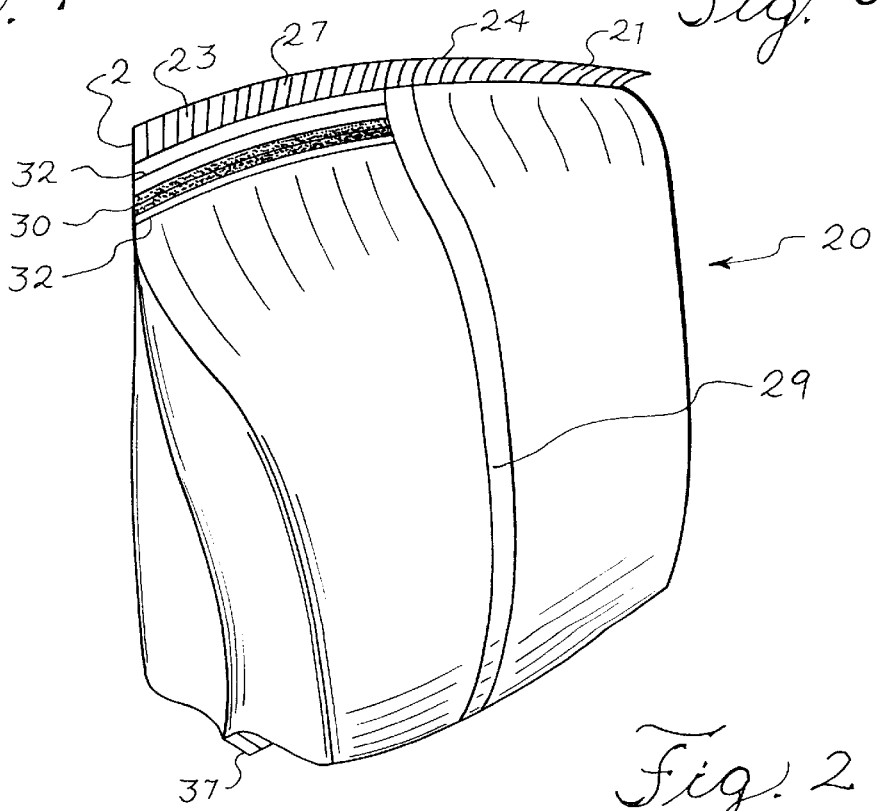
Fig. 2

PARTIALLY ZIPPERED POUCH AND MACHINE FOR MAKING SAME

BACKGROUND OF THE INVENTION

The present invention is directed to an apparatus for making a plastic bag that has a zip type opening that extends across a portion of the top of the bag and the remaining portion of the top of the bag being permanently sealed. The present invention is also directed to the plastic bag itself and the method for making such a plastic bag. More particularly, the invention concerns the use of a vertical form, fill and seal machine for producing and method of making improved reclosable plastic bags on such a machine that when the plastic bag is opened it has a pour spout. A vertical form, fill and seal machine of the type that could be used, in conjunction with a unique change part, for this invention is disclosed in U.S. Pat. No. 5,715,656 that issued on Feb. 10, 1998, which patent is hereby included by reference as a part of this disclosure.

Conventional vertical form, fill and seal packaging machines have been used in a number of ways to accommodate the introduction of a zipper component to thus produce a reclosable package or bag. Reclosable packages including zippered seal have the advantage that they can be zipped closed after having been initially opened. For example, a restaurant might purchase a large capacity bag, having a zipper seal, of frozen French fries, open the package, remove a portion of the contents and then reseal the package and store it in a freezer for future use.

Some reclosable bags produced on vertical form-fill-and-seal machines, produced a plastic package having a zipper connector bonded within the vertical edge seal. The vertical edge, containing the zipper connector, then serves as the top of the filled package.

Conventional vertical form, fill and seal packaging machines, such as that disclosed in U.S. Pat. No. 5,425,216, have been modified to produce reclosable bags by securing the unconnected interlocking members of a zipper connection to the inner surface of a loop formed in the film from which the bag is produced. However, this system requires additional steps to merge the unconnected interlocking members into alignment and then interlock them.

A method of making reclosable bags is disclosed in U.S. Pat. Nos. 4,655,862 and 4,909,017 in which a strip of fastener material is bonded to the film material from which the bag is to be formed before the film reaches the form, fill and seal machine. The strip of fastener material, that is secured to the web includes both halves of the interlocked zipper fastener. The backing strip for only one of zipper components is bonded to the web before the bag forming process commences. The backing strip for the other zipper component is sealed to the film during the cross sealing step of the bag formation. This system of producing reclosable packages has the following problems.

The machine used to bond the strip of fastener material to the film interferes with the necessary servicing of the form, fill and seal machine. The speed of the form, fill and seal machine is limited by the speed of the machine for bonding the strip of fastener to the film. The speed of existing machines for bonding the zip-lock material to the film is slow compared to the potential speed of most modern form, fill and seal machines. Anther problem with the prior art machines is that it is difficult to coordinate the machine that bonds the zip-lock material to the film and the form, fill and seal machine such that the zip-lock material is properly located on the film relative to where the cross seal is formed and the printout carried by the film. Furthermore, existing reclosable bags have a reclosable mechanism that extends across the complete top edge of the bag. It is difficult to pour or meter out the contents of the bag when the bag is open across its complete top edge. Attempts to form a pouring spout by partially closing zipper fastener are not successful since the pressure of the contents being poured or metered out of the bag forces the zipper fastener to open.

An apparatus that can be used to produce the unique packages of this invention has been developed by the inventor of this application and a separate application disclosing and claiming that apparatus is being filed on the same day as this application. The sole inventor of that application is John M. Linkiewicz and the title of that application is ZIPPER SEALER MACHINE. This application is by reference hereby included as a part of this disclosure.

For the foregoing reasons, there is a need for a machine and method for producing plastic bags that have reclosable portions that extend across only a portion of the top of the bag such that when opened the bag has a pouring spout that will restrict and constrain the product contained in the bag from flowing from the bag at an uncontrolled rate.

SUMMARY OF THE INVENTION

The present invention is directed to an apparatus for producing, reclosable packages and to reclosable packages that have a reclosable portion that extends partially across the top of the package. The reclosable portion is of a length that is sufficient, when opened, to form a pouring or metering spout. The present invention also relates to the reclosable package and the method for forming the reclosable package of this invention.

The apparatus for producing the reclosable packages of this invention comprises a zipper sealer machine that is mounted on a conventional vertical form, fill and seal machine. The zipper sealer machine is provided with unique mechanism for securing a zip lock section to the film prior to commencement of the package formation as well as a unique cross sealing jaw that will produce a permanent seal across a first portion of the top seal and easy open or peal seal over the remaining portion of the top seal. The unique cross sealing jaw is constructed such that along its upper portion, which forms the bottom seal for the next bag to be filled, a permanent seal over its entire width is produced. In an embodiment of the cross sealing jaw produces, at a location spaced below the permanent seal over its entire width a easy open or peal seal over a portion and a permanent seal over the remaining portion. This embodiment of the cross seal jaws includes a cutting knife that severs the packages between the permanent seal over its entire width and the seal made up of easy open seal and permanent seal. Also, in this embodiment the cross seal jaws, seal or bond the unbonded flanges of the zip-lock material that extends below the easy open seal and produces a permanent seal below the permanent sea.

In another embodiment of the cross sealing jaw, a second permanent seal extending completely across the package is produced below the permanent seal that will become the bottom of the next bag to be produce. Below this permanent seal that will extend across the complete top to the completed package the cross sealing jaws produce a line of perforations that extend across the width of the package. This line of perforations function to accommodate the easy removal of the above permanent seal extending across the entire top of the package. Below the line of perforations the cross sealing jaws bond the unbonded flanges of a strip of zip-lock material to the internal surface of the package. This strip of sip-lock material extends from an edge of the package to approximately the center of the package. A permanent seal is produced along the remainder of the package.

The invention consist of an apparatus and method for forming a reclosable package have a top seal that includes an easy open or peal open portion that overlays a zip lock section that is reclosable such that when both the top seal easy open portion and the underlaying zip lock section are both open the package has a pouring or mitering spout.

Another embodiment of this invention provides a permanent seal across the entire top of the package and below which is the cross seal comprised of a zip-lock portion and a permanent seal portion. Between these two cross seals a line of perforations are produced which facilitates removing the upper permanent cross seal.

This invention has the advantage over the prior art since the method for securing the zip lock section to the film prior to commencement of the package forming proves does not have the above discussed disadvantages of the prior art.

Another aspect of the present invention is to provide a cross sealing jaw that will produce a cross seal that has a section that will produce a permanent seal and a section that will produce an easy open section. The easy open section overlays a zip lock reclosable section that will enable product contained in the package to be poured or metered through the partially open top and the partially open top can be reclosed and the contents of the package stored until required.

The present invention provides significant advantages over the prior art methods since the unique reclosable package can more accurately pour or meter out product from the package and package can then be reclosed for future use.

For the foregoing reasons there is a need for an apparatus that can perform the method for producing the unique package of this invention that includes a reclosable pour or metering spout.

The present invention, together with further objects and advantages, will be best understood by reference to the following detailed description taken in conjunction with the accompanying drawings.

BRIEF DESCRIPTION OF THE DRAWINGS

FIG. 1 is a front view of an embodiment of the reclosable container of this invention.

FIG. 2 is a perspective view of the reclosable container of this invention.

FIG. 3 is a front view of another embodiment of the reclosable container of this invention.

DETAILED DESCRIPTION OF THE PREFERRED EMBODIMENT

Figure 4:
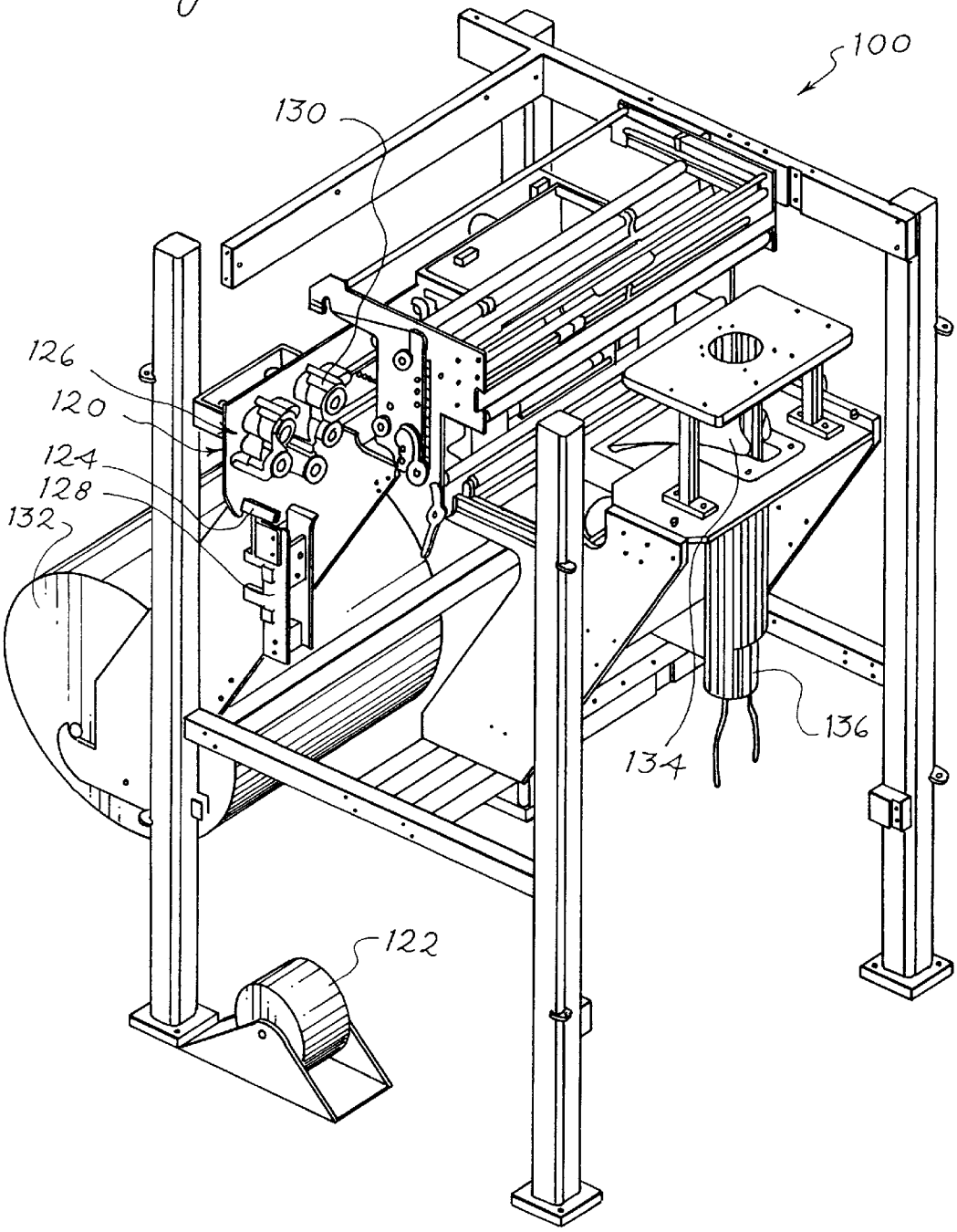
FIG. 4 is a front upper perspective view of a form, fill and seal machine having a reclosable fastener strip attaching mechanism attached thereto.

Referring to the drawings, FIG. 1 is a front view of an embodiment of the reclosable plastic container 20 of this invention. The top edge 24 of this embodiment includes a permanent seal 21 in the right hand portion and an easy open seal 27 in the left hand portion. A reclosable zip closure 30 is secured to the interior confronting surfaces of plastic film from which the container is formed. The securing flanges of the zip closure 30 are indicated at 32. The plastic container 20 has a longitudinally extending seam 29 which is illustrated as a lap seam but which could also be formed as a fin seam. The reclosable plastic container 20 has a permanent cross seal 37 extending across the complete bottom edge 22. Along the right longitudinally extending side of the container 20 a gusset 28 has been formed and along the left longitudinally extending side a limited depth gusset 38 has been formed at the bottom of the container. A full gusset cannot be produced at this location because when producing the cross seals 27 and 37 the limited depth gusset 38 is adjacent and above the pour spout 33. The gussets 28 and 38 are optional but provide a flat bottom for the container 20 which for some uses of the container is a desirable feature.

FIG. 2 is a perspective view of the reclosable plastic container 20 that has been filed with product and sealed.

After the plastic container has been filed and sealed the consumer can open the easy open or peal seal 27 that extends from the left side of the container as seen in FIGS. 1 and 2 toward the center of the container. Although the easy open seal 27 is illustrated as extending from the left side of the container 20 to the approximate center of the container is should be understood that the easy open seal could be shorter or longer depending upon the size of the pour spout 33 desired. The desired size of the pour spout 33 will depend upon the product to be contained in the container. When the easy open seal 27 is opened the top edge 24 of the container has a front flange 23 and a back flange 25 which can be grasped and pulled apart. Flanges 23 and 25 facilitates opening the reclosable zip closure 30. Opening the zip closure 30 forms a pour spout through which the contents of the container can be poured or metered with accuracy. When the desired amount of product has been dispensed the pour spout 33 can be closed by pressing the two halves of the zip closure 30 into interlocked engagement.

FIG. 3 is a front view of another embodiment, designated 40, of this invention. The top edge 42 of this embodiment includes a permanent seal 44 that extends across the entire top edge. Below the permanent seal 44 there is a line of perforations 46 that extent across the entire top of the package. Below the line of perforations 46 and on the left side of the package a zip closure 48 is secured to the interior confronting surfaces of plastic film from which the container is formed. The mounting flanges of the zip closure 48 are indicated at 49. The plastic container 40 has a longitudinally extending seam 50 which is illustrated as a lap seam but which could also be formed as a fin seam. The reclosable plastic container 40 has a permanent cross seal 52 extending across the complete bottom edge 54. Along the right longitudinally extending side of the container 40 a gusset 56 has been provided. The gusset 56 is optional but provide a flat bottom for the container 40 which for some uses of the container is a desirable feature.

After the plastic container 40 has been filled and sealed the consumer can remove the top permanent seal 44 by tearing the package along the line of perforations 46. After the permanent seal 44 has been removed from the package the zip closure 48 can be opened. Although the zip closure 48 is illustrated as extending from the left side of the container 40 to the approximate center of the container is should be understood that the zip closure 48 could be shorter or longer depending upon the size of the pour spout desired. The desired size of the pour spout will depend upon the product to be contained in the container. When the zip closure 48 is opened, the top edge 24 of the container has front and back flanges which can be grasped and pulled apart. These flanges facilitate opening the reclosable zip closure 48. Opening the zip closure 48 forms a pour spout through which the contents of the container can be poured or metered with accuracy. When the desired amount of product has been dispensed the pour spout can be closed by pressing the two halves of the zip closure 48 into interlocked engagement.

FIG. 4 discloses a vertical form, fill and seal machine 100 of the type disclosed in the above identified U.S. Pat. No. 5,715,656. The form, fill and seal machine 100 has a zipper sealer machine 120 mounted thereon. The zipper sealer machine is disclosed in detail in an application filed on the same day as this application. The sole inventor of that application is John M. Linkiewicz and the title of that application is ZIPPER SEALER MACHINE. A continuous supply of zip-lock material is supplied from roll 122. The zip-lock material is fed up through an eyelet 124, up to a primary feeder 126 and then down to a dancer 128. From the dancer 128 the zip-lock material flows up to the secondary feeder that is programmed lo feed a predetermined length of zip-lock material to the cutter-fuser (not shown).

Conventional vertical form, fill and seal machines 100 can be readily adapted to produce bags of different sizes and shapes. As is conventional in vertical form, fill and seal machines 100 a continuous sheet of thermoplastic film, dispensed from a film roll 132, is threaded through a series of rollers and fed to a forming shoulder 134. The forming shoulder 134 causes the thermoplastic film to be wrapped around the forming tube 136 into a continuous tube. The marginal edges of the thermoplastic film are formed into a longitudinal extending seam along the a face of the forming tube 136.

As is conventional in vertical form, fill and seal machines 100 a pair of sealing jaws and a cutting blade moved toward each other, when a bag has been formed and filled with product. The sealing jaws, form a cross or transverse seams in the completed bag and a bottom cross or transverse seam in the next bag to be filled and completed.

In FIG. 4 a strip of zip-lock material of a predetermined length is cut and bonded to the surface of the film being fed to the forming shoulder 134. The reclosable fastener strip 30 include both the male and the female portions of the zip fastener. Each portion of the zip fastener includes mounting flanges that are secured to the film. Only the bottom mounting flange is secured to the top surface of the film at this time in the container forming cycle. As is conventional the top surface of the film 40 will become the inner surface of the package or bag.

As film is fed forward toward the forming shoulder 134, the strip of reclosable fastener is secured to the upper surface of film 40. This securing operation is best performed during a lull in the feeding of the film. When forming the package of this invention the strip of reclosable fastener is cut to a length that is equal to the length of the pour spout for the particular container being produced. The strip must be precisely located on the film surface such that it will, in the completed container, extend from the left side of the container toward the center of the container and be at the proper location when the cross sealing jaws perform the sealing operation. The strip is secured to the inner surface of the package or bag such that it extends in a direction that is normal to the direction that the film is fed. The reclosable fastener can be of any well know and commercially available type.

Figure 5:
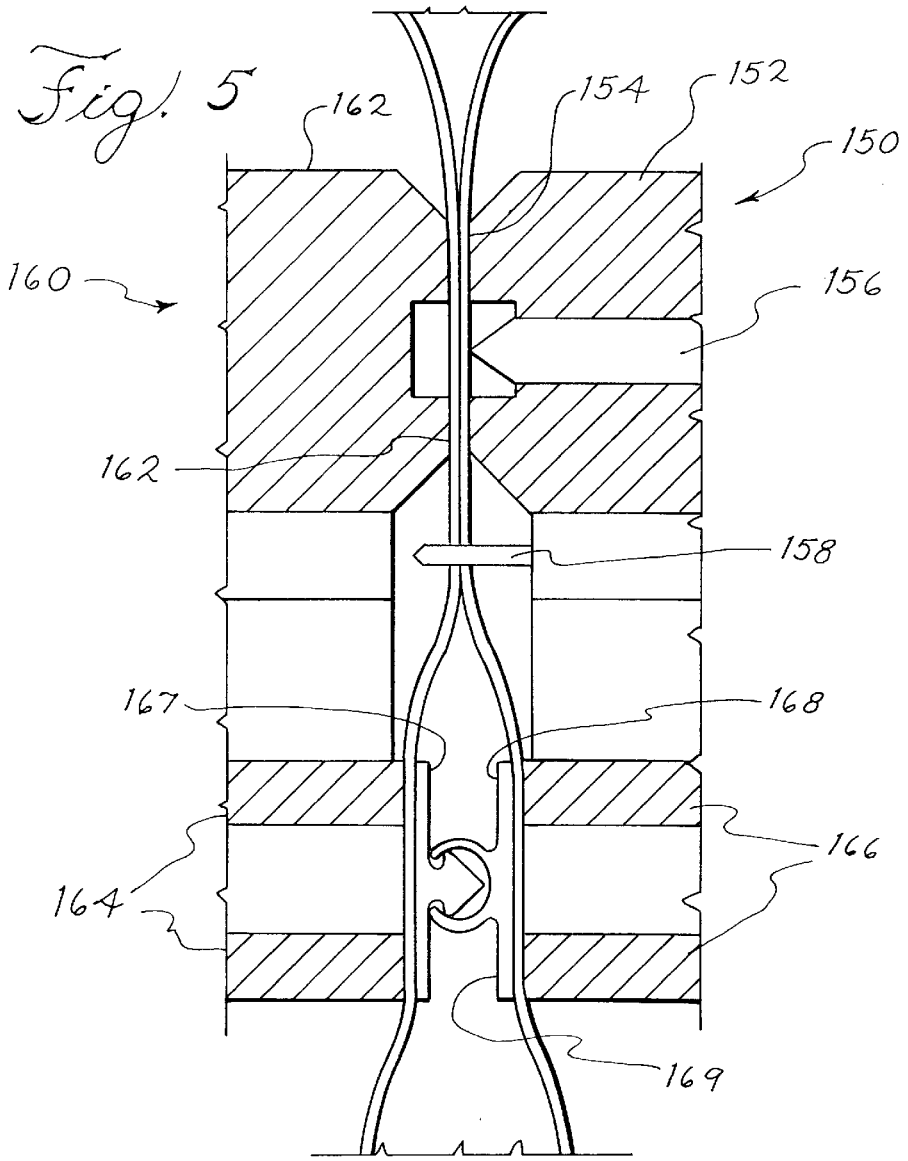
FIG. 5 is a cross-sectional view of cross sealing jaws.
Figure 6:
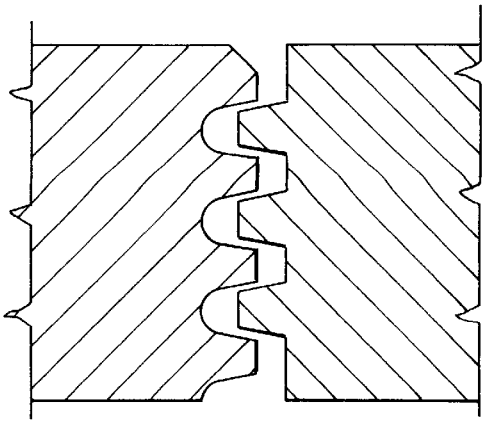
FIG. 6 is a cross-sectional view of another embodiment of the cross sealing jaws.

Reference should be made to FIGS. 5 and 6 for a discussion of the cross sealing jaws. The cross sealing jaws 150 and 160 function to secure the remaining mounting flanges to the inside surface of the package or bag. Referring now to FIG. 5, the cross sealing jaws 150, 160, include heated sections 152 and 162 that engage the outer surface of the bag. The heated sections 152 and 153 form an upper cross seal 154 that becomes the bottom seal of the next package to be produced and also a second cross seal 162 that becomes the top permanent seal 44 in the package illustrated in FIG. 3. Between cross seals 154 and 162 a knife cuts the film and separates the just completed package from the next package to be produced. The cross sealing jaw 152 carries a series of needles 158 are two more sets of heated elements 164 and 166 that perform the function of securing the mounting flanges 167, 168 and 169 to the inner surface of the package.

With reference to FIG. 6 a portion of cross sealing jaws 180 and 182 are shown that would be used to produce the each open or peal seal 27 of FIG. 1.

Although the present invention has been described with reference to a preferred embodiment, those skilled in the art will recognize that changes may be made in form and detail without departing from the spirit and scope of the invention. As such, it is intended that the foregoing detailed description be regarded as illustrative rather than limiting and that the appended claims, including all equivalents thereof, are intended to define the scope of the invention.

What is claimed is:

1. A plastic container having a pour spout that is reclosable, comprising in combination:

a tubular container formed of plastic material;

a top edge formed of a double layer of the tubular material, said top edge having a first end and a second end and having interior confronting surfaces;

said top edge having a permanently sealed portion extending from said first end toward said second end and an easy open seal portion extending from said second end toward said first end;

complementary releasable interfacing rib and groove members secured to said interior confronting surfaces below said easy open seal portion.

2. A plastic container especially adapted to be formed, filled and sealed on a form, fill and seal machine and having a pour spout that is reclosable, comprising in combination:

a tubular container formed of plastic material;

a top edge formed of a double layer of the tubular material, said top edge having a first end and a second end and having interior confronting surfaces;

said top edge having a permanently sealed portion extending from said first end toward said second end and an easy open seal portion extending from said second end toward said first end;

complementary releasable interfacing rib and groove members secured to said interior confronting surfaces below said easy open seal portion.

3. A tubular container formed of a unitary sheet of plastic material that is joined along longitudinally extending edges, said container having a top edge;

a top seal formed at the top edge of the container between confronting faces of the unitary sheet of plastic material and including a portion that is permanently sealed and a portion that can be easily opened;

a rib and groove element secured to the confronting faces of the plastic material below said easily opened portion of said top seal, such that the portion of the container closed by said easily opened portion of said top seal, after being unsealed, functions as a pour spout that can be opened and closed by said rib and groove element.

* * * * *

UNITED STATES PATENT AND TRADEMARK OFFICE

CERTIFICATE OF CORRECTION

PATENT NO. : 5,941,643

DATED : August 24, 1999

INVENTOR(S) : John M. Linkiewicz

It is certified that error appears in the above-identified patent and that said Letters Patent is hereby corrected as shown below:

In the Abstract

Delete the entire Abstract and substitute therefor:

-- A plastic package that has a reclosable fastener extending from one end of the upper edge toward the center of the upper edge and a permanent seal that extends along the remainder of the upper edge. The reclosable fastener can be opened to provide a pour spout for the plastic package. --

Col. 1, line 26, change "seal" to -- seals --;

line 34, change "produced" to -- produce --;

line 51, after "of" insert -- the --.

Col. 2, line 2, change "Anther" to -- Another --;

line 7, after "and" insert -- relative to --;

line 12, after "closing" insert -- the --;

line 17, after "application" (second occurrence) insert

-- , Serial No. 09/056,583, now U.S.Patent No. 6,012,264--;

line 18, delete "is being" and insert -- was --;

line 46, after "with" insert -- a --;

UNITED STATES PATENT AND TRADEMARK OFFICE

CERTIFICATE OF CORRECTION

PATENT NO. : 5,941,643

DATED : August 24, 1999

INVENTOR(S) : John M. Linkiewicz

It is certified that error appears in the above-identified patent and that said Letters Patent is hereby corrected as shown below:

Col. 3, line 18, change "consist" to -- consists --;

line 19, change "have" to -- having --;

line 20, change "peal" to -- peel --;

line 24, change "mitering" -- metering --;

line 26, change "seal across" to -- cross seal traversing --;

line 27, change "zip-lock" to -- zipper lock --;

line 34, delete "proves";

line 40, after "enable" insert -- the --;

line 42, change "open" (both occurrences) to -- opened --;

line 49, after "and" insert -- the --.

Col. 4, line 31, delete "33";

line 36, change "filed" to -- filled --;

line 37, change "filed" to -- filled --;

line 38, change "peal" to -- peel --;

line 42, change "is" to -- it --;

line 48, delete "25";

UNITED STATES PATENT AND TRADEMARK OFFICE

CERTIFICATE OF CORRECTION

PATENT NO. : 5,941,643

DATED : August 24, 1999

INVENTOR(S) : John M. Linkiewicz

It is certified that error appears in the above-identified patent and that said Letters Patent is hereby corrected as shown below:

Col. 2, line 50, after "and" insert -- an --;

line 50, change "peal" to -- peel -;- line 54, delete "In";

line 55, change "an" to -- An --;

line 56, after "seal" insert -- that extends --;

line 57, change "a" (first occurrence) to -- an --;

line 57, change "peal" to -- peel --;

line 57, after "seal" insert -- that extends --;

line 58, after "seal" insert -- that extends --;

line 61, after "seal" insert -- that extends --;

line 62, after "of" insert -- an -- line 62, after "and" (second occurrence) insert -- a --;

line 66, change "sea" to -- seal that extends over the entire width --.

Col. 3, line 4, change "produce" to -- produced --;

line 8, change "function" to -- functions --;

line 13, change "sip-lock" to -- zipper lock --;

UNITED STATES PATENT AND TRADEMARK OFFICE

CERTIFICATE OF CORRECTION

PATENT NO. : 5,941,643

DATED : August 24, 1999

INVENTOR(S) : John M. Linkiewicz

It is certified that error appears in the above-identified patent and that said Letters Patent is hereby corrected as shown below:

Col. 4, line 49, change "facilitates" to -- facilitate --;

line 62, change "extent" to -- extends --;

line 67, after "formed" insert -- and a permanent seal is provided along the remainder of the package --.

Col. 5, line 7, change "provide" to -- provides --;

line 16, change "is" to -- it --;

line 21, after "48 is" insert -- to be --;

line 21, delete "24";

line 35, after "application" insert -- Serial No. 09/056,583 --;

line 44, change "lo" to -- to --;

line 56, change "longitudinal" to -- longitudinally --;

line 60, change "moved" to -- move --;

line 62, change "seams" to -- seam --.

UNITED STATES PATENT AND TRADEMARK OFFICE

CERTIFICATE OF CORRECTION

PATENT NO. : 5,941,643

DATED : August 24, 1999

INVENTOR(S) : John M. Linkiewicz

It is certified that error appears in the above-identified patent and that said Letters Patent is hereby corrected as shown below:

Col. 6, line 33, change "153" to -- 162 --;

line 41, change "152" to -- 150 --;

line 42, change "are" to -- and --;

line 48, change "each" to -- easy --;

line 48, change "peal" to -- peel --.

Signed and Sealed this

Fourth Day of July, 2000

*Attest:*

*Attesting Officer*

Q. TODD DICKINSON

*Director of Patents and Trademarks*